US006426141B1

(12) United States Patent
Mathis et al.

(10) Patent No.: US 6,426,141 B1
(45) Date of Patent: Jul. 30, 2002

(54) HIGH-SPEED FALSE-TWIST TEXTURING PROCESS

(75) Inventors: Raymond Mathis, Duesseldorf; Norbert Bialas, Dormagen; Andreas Lippman, Kaarst, all of (DE)

(73) Assignee: Cognis Deutschland GmbH & Co. KG, Dusseldorf (DE)

( * ) Notice: Subject to any disclaimer, the term of this patent is extended or adjusted under 35 U.S.C. 154(b) by 0 days.

(21) Appl. No.: 09/360,312

(22) Filed: Jul. 23, 1999

Related U.S. Application Data

(60) Provisional application No. 60/045,112, filed on Aug. 3, 1998.

(30) Foreign Application Priority Data

Jul. 24, 1998 (DE) ..... 198 33 305

(51) Int. Cl.[7] ..... D02G 3/00; D06M 9/00; D01D 5/12

(52) U.S. Cl. ..... 428/378; 428/375; 428/377; 252/8.6; 264/210.8

(58) Field of Search ..... 264/210.8; 252/8.6; 428/357, 375, 377

(56) References Cited

U.S. PATENT DOCUMENTS

| | | | | |
|---|---|---|---|---|
| 4,080,301 A | | 3/1978 | Kleber et al. | |
| 4,128,483 A | * | 12/1978 | Ishida et al. | 252/806 |
| 4,165,405 A | * | 8/1979 | Login et al. | 428/395 |
| 4,502,968 A | * | 3/1985 | Noda et al. | 252/8.8 |
| 4,552,671 A | * | 11/1985 | Ogiso et al. | 252/8.9 |
| 4,725,371 A | * | 2/1988 | Lees et al. | 252/8.9 |
| 5,607,634 A | * | 3/1997 | Makino et al. | 264/130 |

FOREIGN PATENT DOCUMENTS

| | | |
|---|---|---|
| DE | 25 28 734 | 12/1976 |
| DE | 269 530 | 7/1989 |
| DE | 281 434 | 8/1990 |
| DE | 281 435 | 8/1990 |
| EP | 0 743 992 | 11/1996 |
| EP | 0 826 815 | 3/1998 |
| EP | 0 826 816 | 3/1998 |
| WO | WO 90/13533 | 11/1990 |

OTHER PUBLICATIONS

Rouette, Hans–Karl, "Lexikon für Textilveredlung," Band 3, pp 1524–1531 and 2180–2183, Dülmen, 1995 Falbe, Juergen, Römpp Lexikon Chemie, pp 2734–2739, Georg Thieme Verlag Stuttgart DIN 53015.

* cited by examiner

*Primary Examiner*—Cynthia H. Kelly
*Assistant Examiner*—J. M. Gray
(74) *Attorney, Agent, or Firm*—John E. Drach; Steven J. Trzaska; Glenn E. J. Murphy

(57) ABSTRACT

The invention relates to a process for the high-speed false twist texturing of yarns of synthetic filaments, in which a finish containing at least one water-soluble lubricant (A) and one water-insoluble liquid (B) with a viscosity of 2 to 50 mPas at 20° C. is applied to the yarns in the form of an aqueous emulsion, after which the filaments are textured on the false twist principle in texturing machines with a short high-temperature heater.

22 Claims, No Drawings

HIGH-SPEED FALSE-TWIST TEXTURING PROCESS

This application claims the benefit of provisional application No. 60/095,112, filed Aug. 3, 1998.

BACKGROUND OF THE INVENTION

1. Field of the Invention

This invention relates to a high-speed false twist texturing process for yarns of synthetic filaments and to the use of a certain finish for this texturing process.

2. Discussion of Related Art

Since the beginning of the eighties, fine bulky polyester yarns (PES) for such applications as clothing or furniture covering materials have mainly been produced by the so-called POY (partially oriented yarn) spinning process followed by false twist stretch texturing.

In false twist stretch texturing, a PES-POY yarn is simultaneously stretched and bulked. The bulk is imparted by intensive twisting of the yarn in its plastic state followed after cooling by untwisting. The plastic state of the yarn is achieved by passing the yarn over a contact heating rail. The twist is mainly imparted by ceramic or polyurethane friction disks (twisting unit). In recent years, the speed of false twist stretch texturing (FT) has been steadily increased (an explanation of the basic principles can be found in H. K. Rouette, Lexikon der Textilveredlung, 1995, pages 1524 to 1531 and 2180 to 2183). Up to the mid-nineties, speeds of 700 m/min to 900 m/min were normal for standard yarns. To achieve these speeds, it had become necessary to use very long heating rails (>2.5 m) generally heated with diphyl. The cooling rails also had to be increased in length to more than 1.5 m. The machines were correspondingly large and difficult to operate. At the beginning of the nineties, false twist stretch texturing machines that were far more compact thanks to the use of novel heaters appeared on the market. The length of the filament path in these machines is distinctly reduced which reduces the buildup of tension and creates the potential for increased speeds. In contrast to traditional contact heaters, of which the temperatures were between 180 and 230° C., the new heaters operate with virtually no contact, but with temperatures of >500° C. By virtue of the very high temperatures, the new heaters could be reduced in length to around 1 m. Although the maximum speed which the generation of high-temperature machines is capable of reaching is generally 1500 m/min., it has been found in practice that speeds of 900 to 1,000 m/min. are rarely exceeded. The reason for this lies in the extremely high yarn breakage rates which occur at higher speeds. It is known that the increase in yam breakages is generally preceded by a proliferation of yarn tension peaks. Accordingly, there is an urgent need for PES-POY yarns which can be processed in the new high-temperature heater texturing machines with a distinctly reduced tendency towards tension peaks and hence to breakages.

Besides improvements in the yarns and the spinning process, the finishes which have to be applied to the yam during spinning and which mainly have a lubricating effect were also looked at with a view to optimization. EP 826 816 A2, for example, describes finishes for use in the false twist texturing of synthetic yarns which contain certain polyether compounds mixed with cyclic polyorganosiloxanes in selected quantity ratios. However, even with these finishes, it is only possible to achieve speeds of up to 1,000 m/min., especially because at temperatures of 350° C. to 500° C. polysiloxanes are thermo-oxidatively degraded to hard silicate deposits on the yarn guides of the high temperature heaters.

The problem addressed by the present invention was to provide finishes for the false twist texturing of synthetic yarns which could even be used under high-speed false twist texturing conditions, particularly in texturing machines with short high-temperature heaters, and which would substantially reduce the number of yarn breakages.

It has now surprisingly been found that the addition of a selected water-insoluble low-viscosity component to lubricants known per se leads to finishes which meet the desired requirement profile.

DESCRIPTION OF THE INVENTION

In a first embodiment, the present invention relates to a process for the texturing of yarns of synthetic filaments in which a finish containing at least one water-soluble lubricant (A) and one water-insoluble liquid (B) with a viscosity of 2 to 50 mPas at 20° C., as measured in accordance with DIN 53015, and optionally emulsifiers and/or wetting agents and other auxiliaries is applied to the yarns in the form of an aqueous emulsion, after which the filaments are textured on the false twist principle in a machine with a short high-temperature heater.

The water-insoluble component (B) is distinguished in particular by its viscosity behavior. Preference is attributed to low-viscosity liquids with a viscosity in the range from 2 to 50 mPas, preferably in the range from 2 to 30 mPas and more particularly in the range from 5 to 25 mPas, as measured at 20° C. in accordance with DIN 53015 using a Höppler viscosimeter. Water-insoluble components (B) with a viscosity of 5 to 10 mPas are particularly advantageous.

Corresponding liquids are selected, for example, from the group of water-insoluble esters of fatty alcohols containing 16 to 24 carbon atoms and/or polyols containing 2 to 6 carbon atoms and 2 to 6 hydroxyl groups with linear or branched, saturated or unsaturated $C_{6-22}$ fatty acids. Suitable fatty alcohols are, for example, palmityl, stearyl, arachidyl or behenyl alcohol. Suitable fatty acids are, for example, caprylic, pelargonic, capric, undecanoic, tridecanoic, myristic, pentadecanoic, palmitic, heptadecanoic, octadecanoic, nonanoic, arachic or behenic acid. Suitable polyols are, for example, glycol, diethylene glycol, glycerol, trimethylol propane or pentaerythritol. The polyols may be completely or partly esterified. The crucial factor is that the compounds should be insoluble in water and, at the same time, should satisfy the viscosity criterion mentioned above. Water-insoluble compounds in the context of the present invention are compounds of which at most 5% by weight and preferably at most 1% by weight dissolves at 20° C. Particularly preferred water-insoluble compounds are esters of branched-chain alcohols obtainable, for example, by Guerbet or oxo synthesis with fatty acids, for example esters of 2-ethylhexyl alcohol with $C_{16-18}$ fatty acids, such as 2-ethylhexyl stearate. Linear fatty acids of this cut are particularly preferred. Besides these long-chain esters, methyl esters of linear or branched, saturated or unsaturated $C_{8-22}$ fatty acids are suitable liquids of type (B). Dicarboxylic acid esters, such as diisooctyl sebacate, diisotridecyl sebacate and diisooctyl esters of azelaic acid, and the water-insoluble reaction products of these compounds with ethylene oxide and/or propylene oxide may also be used as the liquids (B). Water-insoluble esters of thiodipropionic acid, for example with 2-ethyl hexanol, decanol or isotridecyl alcohol, and the water-insoluble reaction products of these compounds with ethylene oxide and/or propylene oxide are also suitable as are the water-insoluble esters of glycol, diglycol or triglycol with $C_{8-22}$ fatty acids and alkoxides thereof.

Other suitable compounds for the liquids (B) are alkoxylated fatty acid esters corresponding to formula (I):

$$R^1—COO—(C_nH_{2n}O)_m—R^2 \quad (I)$$

where $R^1$ is a linear or branched, saturated or unsaturated $C_{7-21}$ alkyl group, $R^2$ is a linear or branched, saturated or unsaturated $C_{1-12}$ alkyl group and n is the number 2 or 3 and m is a number of 1 to 10 and preferably 1 to 6. Particularly preferred compounds of formula (I) are those in which $R^2$ is a short-chain alkyl group containing 1 to 4 carbon atoms. The alkoxylated, preferably ethoxylated or ethoxylated and propoxylated, esters may be obtained by known methods, more particularly in accordance with the teaching of WO-A-90/13533. In the case of mixed alkoxides, the alkoxylation may be carried out in random or block form.

Water-insoluble low-viscosity liquids from the class of symmetrical or asymmetrical dialkyl ethers preferably containing a total of 12 to 44 carbon atoms, for example dioctyl ethers, didecyl ethers or diisotridecyl ethers, are also suitable liquids (B). Other suitable liquids (B) are dialkyl carbonates, such as diisooctyl carbonate, dioctyl carbonate or diisotridecyl carbonate. Alkoxides of the ethers may also be used providing they are insoluble in water and satisfy the viscosity criterion. Besides these compounds, other classes of compounds, more particularly poly-α-olefins, for example poly-1-decenes, or mineral oils may be used as the water-insoluble liquid (B) in the process according to the invention. Generally speaking, the liquid (B) may also contain a mixture of several of the liquids mentioned above.

Besides the water-insoluble liquid (B), the finishes used in the process according to the invention contain at least one lubricant (A) preferably selected from the group of water-soluble reaction products of fatty alcohols containing 4 to 22 carbon atoms or polyols containing 2 to 6 hydroxyl groups and 2 to 6 carbon atoms with ethylene and/or propylene oxide, the reaction products having a molecular weight of 750 to 50,000. Water-soluble reaction products of glycol, ethylene and diethylene glycol or propylene glycol with ethylene and/or propylene oxide with molecular weights in the range from 750 to 50,000 are also suitable. Ethylene oxide/propylene oxide block adducts are preferably used. In their case, it is of advantage with the water solubility of the compounds in mind for the proportion of ethylene oxide groups to be at least 35% (by weight) and preferably at least 45% (by weight), based on all the alkoxide groups in the molecule. Compounds from the group of water-soluble polyether polycarbonates described, for example, in EP-0-743 992 B1 are also suitable lubricants (A).

Particularly preferred lubricants (A) contain several of the reaction products described above. Thus, in one particularly advantageous embodiment, the finish contains 40 to 80% by weight of a water-soluble reaction product with a molecular weight of 750 to 3,000, 5 to 20% by weight of a water-soluble reaction product with molecular weights of >3,000 to 20,000 and at most 5% by weight of a water-soluble reaction product with molecular weights of >20,000 to 50,000 as lubricant component (A). The percentages by weight are all based on the lubricant (A).

The finishes used in the process according to the invention contain the water-insoluble liquid (B) in quantities of preferably 0.2 to 15% by weight and more preferably 0.5 to 10% by weight, based on the finish as a whole. The lubricant (A) may make up as much as 99% by weight of the finish although it is generally present in quantities of 30 to 90% by weight and preferably in quantities of 35 to 60% by weight. Besides components (A) and (B), the finishes contain other optional components, more particularly wetting agents and/or emulsifiers. The wetting agents are generally present in the finishes in quantities of 3 to 20% by weight and the emulsifiers in quantities of 5 to 30% by weight.

Suitable emulsifiers are any anionic, cationic or nonionic emulsifiers. Preferred emulsifiers are those which do not leave any inorganic residues behind at the temperatures normally prevailing in high-temperature texturing heaters (i.e. 300° C. to 550° C). Emulsifiers completely decomposed (<0.2% ash) by conventional incineration (at 900° C.) in ceramic or platinum crucibles are particularly suitable. Accordingly, nonionic emulsifiers are particularly suitable. For example, fatty alcohol alkoxylates with molecular weights below 800, alkoxylated fatty acids, glycols or fatty amines and alkoxylated fatty amines are suitable.

The wetting agents used may be selected from any of the suitable compounds known to the expert for spin finishes. Water-dispersible and, in particular, water-soluble compounds are preferably used. Besides these auxiliaries, the finishes may contain other typical additives, more particularly antistatic agents, filament compacting agents, pH regulators, bactericides and/or corrosion inhibitors. If necessary, these additives may be present in the finishes in typical quantities. In general, they are present in total quantities of up to 15% by weight and preferably 1 to 10% by weight.

The finishes are preferably used in the process according to the invention in the form of an aqueous emulsion containing 1 to 20% by weight and preferably 5 to 12% by weight of the finish. This emulsion is applied to the yarns in the usual way, i.e. by lick rolls or a metering pump and applicator pins, after which the yarns are textured in machines with a short high-temperature heater. The texturing process is based on the false twist principle and may optionally be accompanied by stretching. The claimed process is particularly suitable for false-twist texturing units which operate with almost contactless, short high-temperature heaters. The temperature in the high-temperature heater is 300° C. or higher in at least one zone. Accordingly, the heaters of this machine are in general only at most one meter long. Suitable machines of this type are available, for example, from ICBT (for example ICBT FTF15 E2 HT), Teijin Seiki (Teijin Seiki HTS 1500 or HTS 15V), Barmag (for example Barmag AFK) or RPR (for example RPR 3 SDS). High-speed processes in the context of the present invention are preferably those which operate at a yarn speed of more than 600 m/min. and preferably more than 800 m/min. and, more particularly, at a yarn speed of 900 to 1500 m/min.

The finishes are applied to the yarn in quantities of 0.25 to 0.45% by weight, based on the total weight, by the process according to the invention. The finishes are prepared in known manner by mixing the constituents mentioned with one another in any order in the quantities indicated above at temperatures of 18 to 35° C. and homogenizing the mixture by any known method.

Yarns of synthetic filaments, such as polyester or polyamide, preferably POY polyester yarns, are textured in the process according to the invention.

In another embodiment, the present invention relates to the use of formulations containing at least one water-soluble lubricant (A) and one water-insoluble liquid (B) with a viscosity of 2 to 50 mPas, as measured at 20° C. in accordance with DIN 53015, and optionally emulsifiers and/or wetting agents and other auxiliaries as finishes for the false twist texturing of yarns of synthetic filaments in texturing machines with short high-temperature heaters. To this end, the formulation is preferably used in the form of an aqueous emulsion containing 1 to 20% by weight of the formulation, based on the aqueous emulsion.

EXAMPLES

To demonstrate the advantageous effect of the process according to the invention, the following finishes were tested. The test finishes consisted of a pack 1 and a pack 2. Pack 1 was kept unchanged and consisted of a combination of a wetting agent ($C_{12-14}$ fatty alcohol ethoxylate containing 6 moles of ethylene oxide per mole of fatty alcohol), a high pressure lubricant (a water-soluble ethylene oxide/propylene oxide adduct with a molecular weight of 5,000 to 20,000 based on pentaerythritol), a water-soluble methyl-capped polyethylene glycol pelargonate and a $C_{16-18}$ fatty-alcohol-started block ethylene oxide/propylene oxide emulsifier (5 moles ethylen eoxide (EO), 9 moles propylene oxide (PO) per mole fatty alcohol). Pack 1 made up 47% of the finish as a whole. Pack 2, which represented 53% of the finish as a whole, consisted of four components:

(I) water-soluble butanol-started EO/PO adduct, MW ca. 1,000

(II) water-soluble butanol-started EO/PO adduct, MW ca. 1,700

(III) water-soluble tetrol-started EO/PO adduct, MW ca. 7,000

(IV) 2-ethylhexyl stearate, viscosity at 20° C.: 15 to 17 mpas.

Component (IV) represents water-insoluble component (B) according to the invention of the finish. The compositions of the test finishes are set out in Table 1. A combination of pack 1 with lubricants (I) and (III) was tested as reference.

TABLE 1

(figures = % by weight):

| | Ref. | 1 | 2 | 3 | 4 | 5 | 6 | 7 |
|---|---|---|---|---|---|---|---|---|
| I | 65.0 | | | 40.0 | 29.5 | | | 20.5 |
| II | | 40.0 | 41.0 | | 9.50 | 46.0 | 36.0 | 20.5 |
| IV | | 9.0 | 3.0 | 9.0 | 7.5 | 3.0 | 3.0 | 3.0 |
| III | 6.0 | 5.0 | 10.0 | 5.0 | 7.5 | 5.0 | 15.0 | 10.0 |
| Pack 1 | 29.0 | 46.0 | 46.0 | 46.0 | 46.0 | 46.0 | 46.0 | 46.0 |

TABLE 1-continued (figures = % by weight):

| | 8 | 9 | 10 | 11 | 12 | 13 | 14 | 15 |
|---|---|---|---|---|---|---|---|---|
| I | 36.0 | 38.0 | | 21.5 | 9.5 | 15.0 | 46.0 | 30.0 |
| II | | | 30.0 | 21.5 | 29.5 | 15.0 | | |
| IV | 3.0 | 6.0 | 9.0 | 6.0 | 7.5 | 6.0 | 6.0 | 6.0 |
| III | 15.0 | 10.0 | 15.0 | 5.0 | 7.50 | 9.0 | 3.0 | 9.0 |
| Pack 1 | 46.0 | 46.0 | 46.0 | 46.0 | 46.0 | 46.0 | 46.0 | 46.0 |

All the above-mentioned finishes were applied during spinning to a typical PES-POY yarn. The add-on was 0.3%. The key spinning parameters and POY yarn data were as follows:

Spinning and POY Yarn Parameters 1

Spinning speed: 3500 m/min.

Yarn type: 256 dtex, 36 filaments

Strength: ca. 23.5 cN/tex

Elongation: ca. 103%

Finishing: Barmag gear pumps and ceramic applicator

Emulsion concentration: 10%

Finish add-on: 0.30%

After storage for at least 24 hours, all the yarns were successively stretch-textured at the same 8 stations of an RPR SDS HTSH machine. The texturing parameters were adjusted as follows:

Texturing Parameters 1

Machine type: RPR 3 SDS

Friction unit: Temco FTS 521 M

Unit configuration: 1-6-1, Temco 630F 9 mm polyurethane working disks

Tension limit for fault alarm: +/−2 cN

Winding speed: 1000 m/min.

DY ratio: 1.80

Stretching ratio: 1.61

Heater temperature:

500° C.—first zone

500° C.—second zone

Fixing heater temp.: switched off

The following values were measured during texturing (Table 2).

TABLE 2

| Finish | Ref. | 1 | 2 | 3 | 4 | 5 | 6 | 7 |
|---|---|---|---|---|---|---|---|---|
| t1 [cN] | 79 | 82 | 82 | 80 | 80 | 80 | 83 | 78 |
| t2 [cN] | 56 | 53 | 52 | 56 | 53 | 53 | 52 | 54 |
| t2/t1 | 0.71 | 0.65 | 0.63 | 0.71 | 0.67 | 0.67 | 0.63 | 0.69 |
| $S_a$t2 [cN] | 0.5 | 0.5 | 0.4 | 0.4 | 0.4 | 0.4 | 0.4 | 0.4 |
| CV [%] | 0.8 | 1.0 | 0.8 | 0.7 | 0.8 | 0.8 | 0.8 | 0.8 |
| Mean olt/posit. | 58.9 | 11.0 | 37.6 | 6.3 | 9.1 | 16.3 | 12.9 | 14.6 |
| Denier [dtex] | 167.4 | 168.0 | 164.2 | 168.7 | 169.8 | 164.8 | 168.2 | 164.9 |
| Strength [cN/tex] | 41.2 | 41.0 | 42.1 | 40.9 | 40.0 | 41.7 | 40.8 | 41.8 |
| CV [%] | 3.5 | 3.1 | 2.6 | 2.8 | 4.4 | 5.5 | 3.9 | 2.8 |
| Elongation [%] | 20.4 | 20.7 | 20.4 | 20.7 | 20.7 | 20.5 | 20.5 | 20.6 |
| CV [%] | 4.9 | 4.5 | 5.7 | 5.2 | 6.5 | 6.8 | 5.4 | 5.2 |
| Crimp contraction [%] | 38.4 | 39.4 | 37.7 | 39.9 | 39.4 | 40.1 | 40.1 | 38.5 |
| Crimp stability [%] | 88.9 | 89.3 | 88.2 | 89.8 | 89.5 | 89.7 | 89.5 | 88.9 |
| Fluffing [1/100 km] | 7.5 | 5.0 | 7.5 | 0.0 | 7.5 | 0.0 | 15.0 | 7.5 |
| Snarling [1/100 km] | 0.0 | 2.5 | 2.5 | 0.0 | 0.0 | 0.0 | 0.0 | 0.0 |
| Surging [m/min] | 1150 | 1200 | 1150 | 1200 | 1150 | 1150 | 1150 | 1150 |
| Finish | 8 | 9 | 10 | 11 | 12 | 13 | 14 | 15 |
| t1 [cN] | 81 | 81 | 81 | 81 | 81 | 81 | 80 | 81 |
| t2 [cN] | 54 | 56 | 52 | 55 | 53 | 55 | 56 | 54 |

TABLE 2-continued

| | | | | | | | | |
|---|---|---|---|---|---|---|---|---|
| t2/t1 | 0.67 | 0.70 | 0.65 | 0.69 | 0.65 | 0.68 | 0.70 | 0.67 |
| $S_a$t2 [cN] | 0.4 | 0.4 | 0.4 | 0.4 | 0.5 | 0.5 | 0.4 | 0.4 |
| CV [%] | 0.7 | 0.7 | 0.8 | 0.7 | 0.9 | 0.8 | 0.8 | 0.7 |
| Mean olt/posit. | 21.6 | 9.6 | 4.7 | 16.9 | 7.0 | 1.63 | 15.6 | 2.5 |
| Denier [dtex] | 164.9 | 164.5 | 164.6 | 167.8 | 164.4 | 167.3 | 167.6 | 168.0 |
| Strength [cN/tex] | 42.0 | 42.4 | 42.4 | 41.1 | 42.4 | 41.5 | 40.9 | 41.6 |
| CV [%] | 2.6 | 2.5 | 2.7 | 4.0 | 2.6 | 3.1 | 9.3 | 3.0 |
| Elongation [%] | 21.1 | 20.9 | 20.9 | 20.6 | 21.0 | 21.0 | 20.4 | 21.0 |
| CV [%] | 5.0 | 4.9 | 47 | 6.8 | 5.5 | 5.5 | 5.9 | 4.9 |
| Crimp contraction [%] | 38.3 | 39.0 | 38.9 | 39.2 | 39.4 | 38.8 | 39.2 | 39.4 |
| Crimp stability [%] | 88.7 | 89.5 | 89.3 | 89.0 | 89.3 | 89.2 | 89.3 | 89.5 |
| Fluffing [1/100 km] | 2.5 | 0.0 | 2.9 | 0.0 | 0.0 | 2.5 | 2.5 | 2.5 |
| Snarling [1/100 km] | 0.0 | 0.0 | 0.0 | 0.0 | 0.0 | 0.0 | 0.0 | 0.0 |
| Surging [m/min] | 1150 | 1150 | 1150 | 1150 | 1150 | 1150 | 1150 | 1100 |

Explanation of Abbreviation t1: yarn tension before the texturing unit t2: yarn tension after the texturing unit t2/t1: ratio between the two tensions Mean olt/posit.: number of times tension limit was exceeded over 4 hours $S_a$: standard deviation CV: coefficient of variation Surging: speed at which the process becomes unstable As can be seen from the results Table, the process and yarn data are at a very good level. In particular, the number of times the tension limit is exceeded, which is responsible for yarn breakages, is distinctly reduced by comparison with conventional finishes.

In order to verify the general validity of the claim that the addition of a water-insoluble liquid (B) to texturing finishes considerably reduces the frequency of yam tension peaks, the following four finishes were tested on a another PES-POY spinning machine: reference, 13, 3 and 9.

Spinning and POY Yarn Parameters 2

Spinning speed: 3300 mlmin.

Yarn type: 167 dtex, 30 filaments

Finishing: Barmag gear pumps and ceramic applicator

Emulsion concentration: 10%

Finish add-on: 0.30%

Texturing Parameters 2

Machine type: Barmag FK6 V80 with high-temperature heaters

Friction unit: Temco type 8

Unit configuration: 1-6-1, Hokushin 9 mm polyurethane working disks

Tension limit for fault alarm: +/−3 cN

Winding speed: 900 m/min.

D/Y ratio: 1.8

Stretching ratio: 1.76

Heater temperature:

380° C.—first zone

400° C.—second zone

Fixing heater temp.: switched off

Results

| Finish | Reference | 13 | 3 | 9 |
|---|---|---|---|---|
| No. of times tension limit is exceeded over 4 hours | 108 | 18 | 17 | 18 |

In this case, too, the advantageous effect of the process according to the invention in clearly reducing the frequency of tension peaks during the texturing process is apparent.

Tests were carried out with another water-insoluble low-viscosity component (B). Finish 9 was selected as the basic formulation (quantities in % by weight).

| | 9 | 16 | Viscosity of component (B) at 20° C. (mPas) |
|---|---|---|---|
| (I) | 38.0 | 38.0 | |
| (III) | 10.0 | 10.0 | |
| 3-Ethylhexyl stearate | 6.0 | | 15 to 17 |
| Octyl caprylate | | 6.0 | 4 to 7 |
| Pack 1 | 46.0 | 46.0 | |

All four finishes were applied on a POY spinning machine with the spinning and POY yarn parameters 2. The yarns were then textured on an RPR 2 SDS high-temperature heater machine.

Texturing Parameters 3

Machine type: RPR 3 SDS

Friction unit: Temco FTS 521 M

Unit configuration: 1-6-1, Temco 630F 9 mm polyurethane working disks

Tension limit for fault alarm: +/−3 cN

Winding speed: 1000 m/min.

D/Y ratio: 1.76

Heater temperature:

500° C.—first zone

500° C.—second zone

Fixing heater temp.: switched off

Results

| Finish | 9 | 16 |
|---|---|---|
| No. of times tension limit is exceeded over 4 hours | 36 | 25 |

It can be seen that a reduction in the viscosity of component (B) also reduces the number of times the tension limit is exceeded and hence the risk of yarn breakage.

What is claimed is:

1. A process for the texturing of yarns of synthetic filaments comprising applying to a synthetic yarn filament a finish containing at least one water-soluble lubricant (A) and one water-insoluble liquid (B) with a viscosity of 2 to 50 mPas at 20° C. in the form of an aqueous emulsion, and false twist texturing the finished yarn in a machine having a short high-temperature heater.

2. A process according to claim 1 wherein the water-insoluble liquid (B) has a viscosity of 2 to 30 mPas at 20° C.

3. A process according to claim 2 wherein the water-insoluble liquid (B) has a viscosity of 5 to 25 mPas at 20° C.

4. A process according to claim 3 wherein the water-insoluble liquid (B) has a viscosity of 5 to 10 mPas at 20° C.

5. A process according to claim 1 wherein the water-insoluble liquid (B) comprisies a compound selected from the group consisting of water-insoluble esters of fatty alcohols containing 16 to 24 carbon atoms or polyols containing 2 to 6 carbon atoms and 2 to 6 hydroxyl groups with linear or branched, saturated or unsaturated $C_{6-22}$ fatty acids.

6. A process according to claim 1 wherein the finish comprises a liquid (B) selected from water-insoluble esters of $C_{16-18}$ fatty acids with 2-ethylhexyl alcohol.

7. A process according to claim 1 wherein the finish comprises a liquid (B) selected from the group consisting of water-insoluble compounds corresponding to formula (I):

$$R^1—COO—(C_nH_{2n}O)_m—R^2 \quad (I)$$

wherein $R^1$ is a linear or branched, saturated or unsaturated $C_{7-21}$ alkyl group, $R^2$ is a linear or branched, saturated or unsaturated $C_{1-12}$ alkyl group, n is 2 or 3, and m is 1 to 10.

8. A process according to claim 7 wherein m of formula I is a number of 1 to 6.

9. A process according to claim 7 wherein $R^2$ of formula I is an alkyl group containing 1 to 4 carbon atoms.

10. A process according to claim 1 wherein the finish comprises a liquid (B) selected from the group consisting of water-insoluble dialkyl ethers, dialkyl carbonates, dicarboxylic acid esters, diesters of thiodipropionic acid, poly-α-olefins and mineral oil.

11. A process according to claim 1 wherein the finish comprises a water-soluble lubricant (A) selected from the group consisting of reaction products of $C_{4-22}$ fatty alcohols or of polyols containing 2 to 6 hydroxyl groups and 2 to 6 carbon atoms with ethylene oxide, propylene oxide or mixtures thereof, wherein the reaction products have a molecular weight of 750 to 50,000.

12. A process according to claim 11 wherein the finish comprises a lubricant (A) containing 40 to 80% by weight of reaction products with a molecular weight of 750 to 3,000, 5 to 20% by weight of reaction products with molecular weights of between 3,000 to 20,000 and at most 5% by weight of reaction products with molecular weights of between 20,000 to 50,000.

13. A process according to claim 1 wherein the finish comprises 30 to 90% by weight of lubricant (A).

14. A process according to claim 13 wherein the finish comprises 35 to 60% by weight of lubricant (A).

15. A process according to claim 1 wherein the finish comprises 0.2 to 15% by weight of the water-insoluble liquid (B).

16. A process according to claim 15 wherein the finish comprises 0.5 to 10% by weight of the water-insoluble liquid (B).

17. A process according to claim 1 wherein the finish further comprises 5 to 30% by weight based on the finish of emulsifiers, 3 to 20% by weight based on the finish of wetting agents or mixtures thereof.

18. A process according to claim 1 wherein the aqueous emulsion comprises 1 to 20% by weight of the water-soluble lubricant (A) and water-insoluble liquid (B).

19. A process according to claim 18 wherein the the aqueous emulsion comprises 5 to 12% by weight of the water-soluble lubricant (A) and water-insoluble liquid (B).

20. A process according to claim 1 wherein the yarn comprises polyester filaments.

21. A process according to claim 1 wherein the finish is applied to the yarn in quantities of 0.25 to 0.45% by weight, based on the weight of the yarn.

22. A false twist textured yarn comprising synthetic filaments and 0.25% to 0.45% of a finish comprising:

(A) a water-soluble lubricant; and (B) a water-insoluble liquid having a Brookfield viscosity of 2 to 50 mPas at 20° C.

* * * * *